US005799480A

United States Patent [19]

Cerato

[11] Patent Number: 5,799,480

[45] Date of Patent: Sep. 1, 1998

[54] ORNAMENTAL CHAIN

[75] Inventor: Silverio Cerato, Mussolente, Italy

[73] Assignee: Silmar S.p.A., Romano D'Ezzelino, Italy

[21] Appl. No.: 698,429

[22] Filed: Aug. 15, 1996

Related U.S. Application Data

[63] Continuation-in-part of Ser. No. 443,417, May 22, 1995, abandoned.

[30] Foreign Application Priority Data

May 31, 1994 [IT] Italy ..... VI94A0085

[51] Int. Cl.[6] ..... B21L 17/00

[52] U.S. Cl. ..... 59/30; 59/35.1; 59/80; D11/13

[58] Field of Search ..... D11/13, 14, 15, D11/12; 59/30, 35.1, 28, 78, 80, 84

[56] References Cited

U.S. PATENT DOCUMENTS

| | | | |
|---|---|---|---|
| D. 334,352 | 3/1993 | Bichi | D11/15 |
| D. 334,901 | 4/1993 | Bichi | D11/12 |
| D. 334,904 | 4/1993 | Bichi | D11/18 |
| D. 338,630 | 8/1993 | Bichi | D11/24 |
| D. 365,777 | 1/1996 | Scortecci et al. | D11/12 |
| D. 375,700 | 11/1996 | Bonarini et al. | D11/13 |
| D. 377,629 | 1/1997 | Lunardon | D11/13 |

FOREIGN PATENT DOCUMENTS

| | | | |
|---|---|---|---|
| 506631 | 9/1992 | European Pat. Off. | 59/80 |
| 685229 | 3/1965 | Italy | 59/80 |
| 86/04491 | 8/1986 | WIPO | 59/80 |

*Primary Examiner*—David Jones
*Attorney, Agent, or Firm*—Bucknam and Archer

[57] ABSTRACT

A process for making an ornamental chain which has portions of different width consists of subjecting links of same size, same shape and same diameter of the wire to different compression between two clamps. In the chain produced by the process there are portions of constant width and intermediate portions of the degradé type, with increasing or decreasing profile.

12 Claims, 2 Drawing Sheets

ORNAMENTAL CHAIN

This application is a cip of U.S. application Ser. No. 08/443,417, filed May 22, 1995, now abandoned.

FIELD OF THE INVENTION

The present invention relates to a process for the manufacture of an ornamental chain of the type "degradé" as well as a chain obtained by this process.

BACKGROUND OF THE PRIOR ART

It is well known that one of the processes for the production of chains used in the jewelry industry resides in the use of small rings, particularly shaped, which are subsequently joined forming a chain which has a particular shape according to the manner how the small rings are joined among themselves.

Subsequently the chain so obtained is subjected to further operations such as compression and beating, operations which are also known. With the operation of compression the rings are brought closer among themselves while with the beating operation the chain is caused to go between two beating structures capable of determining the squashing which transforms the chain into a plate. After the two operations mentioned hereinabove are carried out, the chain in the form of a plate turns out to be composed of small rings, commonly called links, joined among themselves which form flat strips slightly staggered twilled bands.

A particular aesthetic conformation of the plate obtained after the operations of compression and beating resides in the fact that it presents sections of different width. By way of example, an ornamental article which has this characteristic is commercially called "chain degradé" and consists of necklaces and bracelets constituted by a central portion of the chain having a width greater with respect to the two lateral portions which close the necklace or the bracelet.

According to the present state of the art, the manufacture of ornamental articles of the type "chain degradé" is obtained by using rings or links of different size and different diameter of the wire in relation to the width of the portion which one is trying to achieve. Specifically in the part of the chain which must have a greater width there are used rings or links having greater dimensions and diameters of the wire with respect to the dimensions and the diameters of the wire of the rings or links which constitute the remaining part of the chain and which have a smaller width.

In this manner, however, there are some drawbacks from the production, economical and also aesthetic point of view.

The economical drawback derives from the fact that in order to produce the part of the chain which has a greater width, it is necessary to use rings of greater dimensions and having a greater diameter of the wire, a fact which involves greater consumption of precious metal. Another drawback is due to the fact that by using rings of different dimensions, the strips which are obtained with the beating operation are not homogenous and in the case in which a limited number of links for each section of different dimensions is used, the variation of the width of the chain is not gradual and continuous so that the resulting aesthetic chain is not satisfactory from the aesthetic point of view.

SUMMARY OF THE INVENTION

An object of the present invention is to produce an ornamental chain of the type degradé which has such properties to guarantee novel results both from the production as well as aesthetic point of view with respect to what has been possible to achieve with similar chains of known type which have sections of different width.

This is achieved according to the invention by using a process which permits to achieve an ornamental chain of the degradé type by using always the same type of links, that is rings with same shape, equal dimensions and the same diameter of the wire for all the portions of the chain which have different width and which constitute the same chain.

In particular, with the process according to the present invention and by using advantageously only one type of links or rings, it is possible to obtain at least three portions of the chain of which the first one has a width greater with respect to the second one and there is a third portion which connects the first portion and the second portion and which has advantageously a profile which joins gradually the first and the second portion.

The novelty of the present invention resides in the process for the manufacture of the ornamental chain of the degradé type by using a single type of links, the process consisting of subjecting some minimal portions of the chain to a compression action in the longitudinal direction of variable intensity in such a manner that each link in addition to approaching the next link undergoes a particular and well defined deformation of configuration.

In particular, the links which constitute the chain may be essentially compared to a ring having a rhomboidal profile in which the width of the chain depends on the dimension of the diagonal of the geometric profile which is essentially perpendicular to the longitudinal direction of the same chain. The result is that by compressing the link having the rhomboidal shape in the direction of the diagonal essentially corresponding to the longitudinal direction of the chain, the link is deformed in a manner to constitute a new rhomboidal profile in which by decreasing the length of the same diagonal, one achieves as a result an increase of the length of the other diagonal, that is the diagonal which is disposed essentially perpendicularly to the same direction and this brings about consequently an increase in the width of the same chain.

On the basis of what has been said hereinabove, it therefore easy to understand that by applying pressure to a different extent, one obtains links of different height which are interlaced among themselves and reciprocally brought close to one another and they constitute a portion of the chain having a variable profile which may be increasing or decreasing as commercially called degradé.

In operation, the procedure of squashing as described hereinabove is carried out by causing the chain to slide with small portions of the chain being engaged by two clamps which are coaxial with the same chain. According to a first embodiment, the first clamp blocks the front end of the portion of the chain to be compressed while the second clamp anchors itself to the rear end of the same portion. The first clamp after having blocked the chain remains still while the second clamp, after the jaws of the clamp have grasped the chain, moves in such a manner as to come close to the first clamp so that in this manner the compression action of the portion of the chain is achieved and consequently also the deformation of the links which constitute the same chain.

According to another embodiment of the invention, both clamps are mobile and move in such a manner as to come close one to the other whereby the compression action of the same portion of the chain is achieved.

By suitably regulating the length of the course of the linear displacement of the second clamp, the one which is mobile, in the direction of the first still clamp, or the displacement of the reciprocal approachment of both clamps, it is possible to obtain different deformations or a different squashing of each link so that the final result is that a different width of the portion of the chain being worked is achieved.

Finally the process according to the present invention utilizes for the command and control of the motions of opening and closing and displacement of the two clamps an electronic or mechanical system which are known and which makes possible to obtain rapid impulses and an automatic continuous micrometric regulation, the impulses being necessary to achieve compressions of the links of the necklace in the order of a few hundredths of a millimeter and with very rapid sequences.

This invention is intended also to be extended to the chain obtained with the process according to the present invention.

These and other characteristics of the invention will appear more evident by reference to the accompanying drawings of which:

Figure 4:
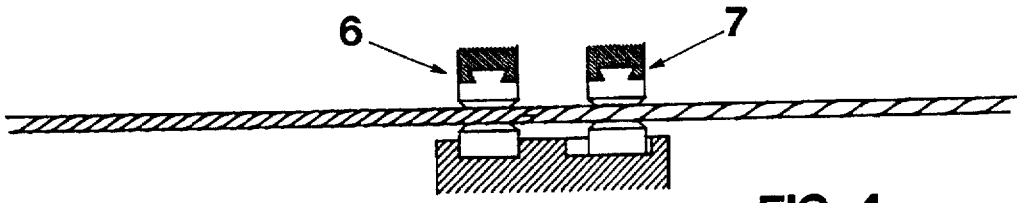
FIG. 4 is an elevational schematic view of the apparatus to be used to carry out the process of the present invention.
Figure 3:
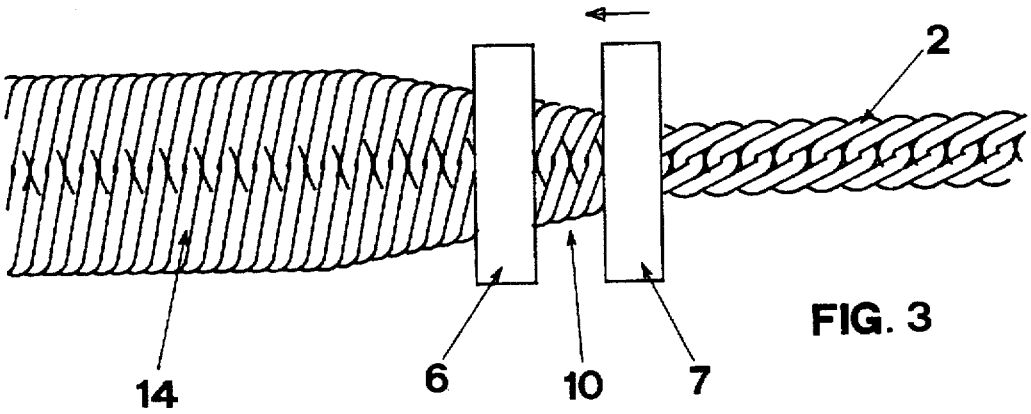
FIG. 3 shows a schematic view of the apparatus to be used for carrying out the process of the present invention.
Figure 2:
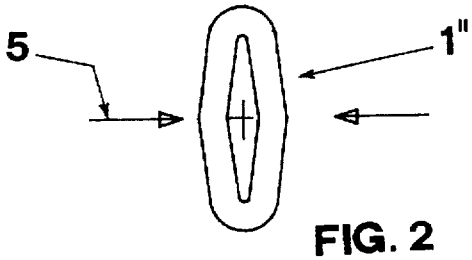
FIG. 2 illustrates a ring or link of the chain after the compression process of the present invention.
Figure 1:
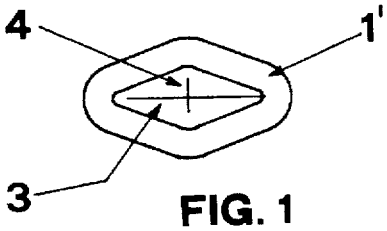
FIG. 1 illustrates a ring or link of the chain prior to application of the compression process of this invention.

As shown in FIGS. 1 and 2, the ring or the link (1) which constitutes chain (2) is comparable essentially to an annular element having a rhomboidal profile which has the two diagonals (3) and (4) disposed respectively in the direction (3) in agreement with the longitudinal arrangement of the chain and in the direction (4) perpendicular to direction (3). The dimension of diagonal (4) determines the height of the chain.

With the process according to the present invention as described in detail hereinbelow, the link (1) is deformed in the direction shown by the arrows (5) so that by squashing along the diagonal (3) the height increases in the direction of the other diagonal (4). The operation to obtain a chain of the degradé type and which constitutes the novel process of the present invention comprises a longitudinal compression action having variable values which is obtained by letting the chain slide, the chain engaging in sequence a small portion (10) between two clamps (6) and (7) which are coaxial with the chain.

The first clamp (6) blocks the front end of the small portion (10) while the second clamp (7) anchors itself to the rear end of the same portion. The first clamp (6) remains fixed while the second clamp (7) moves in such a manner as to come close to the first clamp by carrying out the compression of the intermediate small portion (10).

The value of the displacement of the mobile clamp (7) is variable and may be regulated by electronic or mechanical devices which are known.

Figure 5:
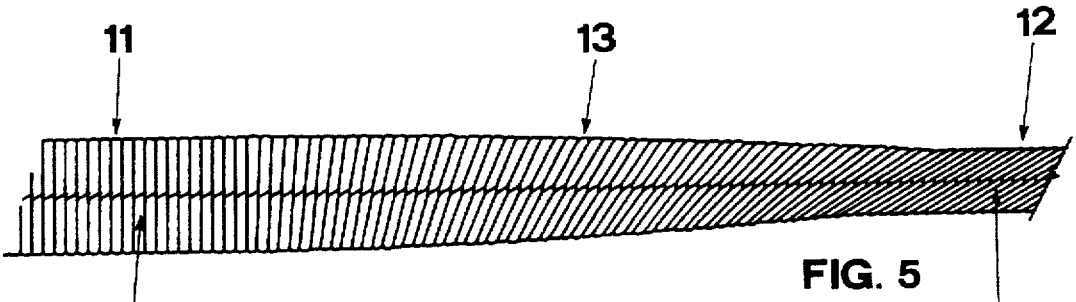
FIG. 5 illustrates a front schematic view of a chain having a portion of decreasing width comprised between two portions of constant width obtained by the process of the present invention.
Figure 6:
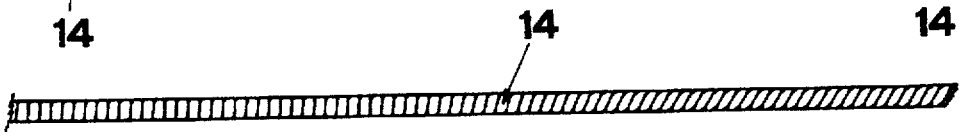
FIG. 6 illustrates a side view of the portion of the chain of FIG. 5.

By the use of constant values of the displacement of the mobile clamp (7) one obtains portions (11) and (12) of the chain of a constant width and on the contrary by using values progressively variable in continuous manner of the same clamp, one obtains a portion (13) having degradé profile increasing or decreasing as shown in FIG. 5.

In view of the explanation hereinabove, it is evident that the novelty of the process of the present invention permits to carry out the compression action of very small portions of the chain and to regulate and vary in a continuous manner the displacement of at least one of the two clamps so that it is possible to achieve minimal portions which being subjected to a compression action with different values exhibit a different width.

The difference in the width of a portion of the chain with respect to the adjacent portion becomes small because the values of compression of each individual link may be regulated with continuity and in a micrometric manner. These portions having a minimal difference in height and being close one to the other and compressed bring about advantageously a portion of the chain of the degradé type in which the profile increasing or decreasing, becomes perfectly linear in such a gradual manner to be aesthetically satisfactory.

A further novel feature of the present invention resides in the fact that the links (14) which constitute the several portions of the chain (11), (12) and (13) exhibit the same conformation and the same initial dimensions and are obtained with the same diameter of the wire.

By application of the process according to the present invention, it is possible to make a chain in such a manner that it will have portions of constant width separated with portions of the degradé type, that is with an increasing or decreasing profile.

Figure 7:
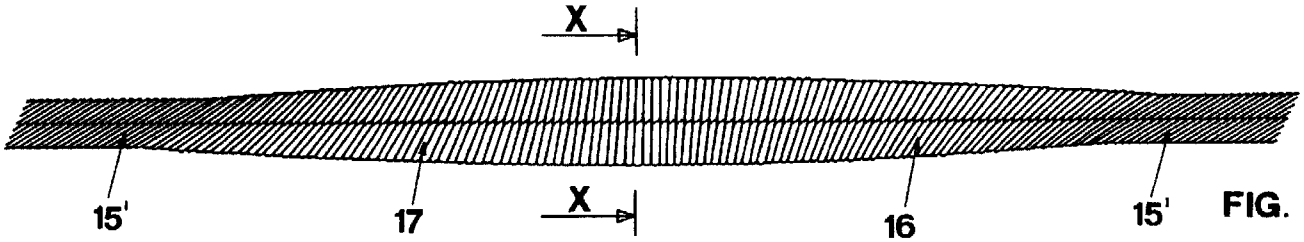
FIG. 7 shows a front view of a chain which has in the interior of a portion of a constant width two symmetrical portions opposite one to the other joined between themselves and having both an increasing and decreasing degradé profile.
Figure 8:
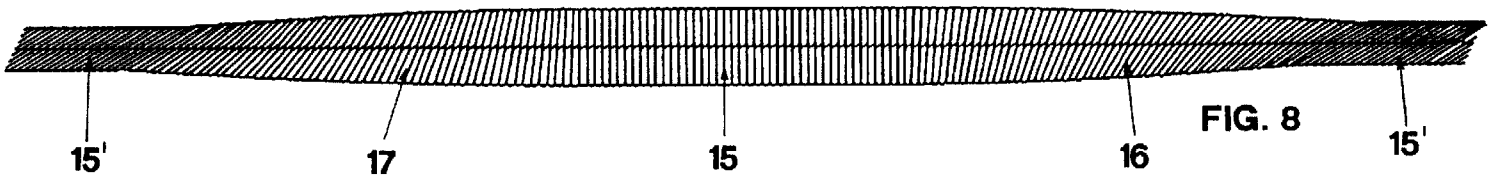
FIG. 8 is a front view of a chain which has two portions symmetrically opposite one to the other with an increasing and decreasing profile between which there is placed a portion of constant width.
Figure 9:
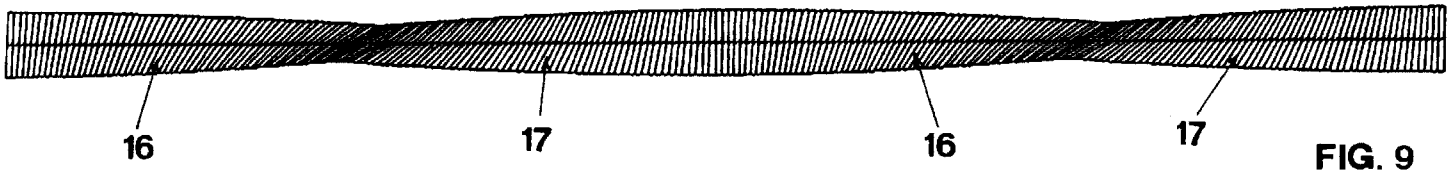
FIG. 9 illustrates a front view of a chain which has a plurality in sequence of portions having an increasing or decreasing profile.
Figure 11:
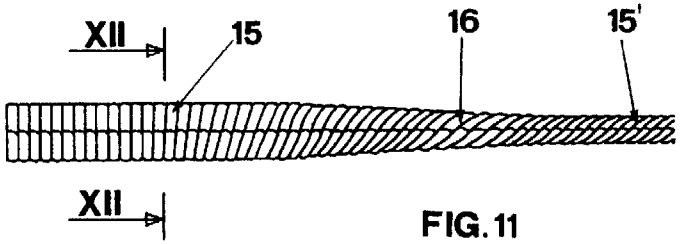
FIG. 11 illustrates a portion of the degrade chain of the round type.
Figure 12:
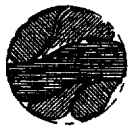
FIG. 12 illustrates a cross section according to line XII—XII of FIG. 11 of the same chain.
Figures 10A, 10B, 10C:
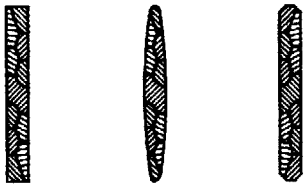
FIG. 10A illustrates a transversal cross section of the chain according to line X—X of FIG. 7 of the flat type.
FIG. 10B illustrates a transversal cross section of the chain according to line X—X of FIG. 7 of the oval convex type.
FIG. 10C is a transversal cross section of the chain according to line X—X of FIG. 7 of the diamond type with six facets.

FIGS. 7, 8 and 9 show three possible embodiments of the chain obtained with the above described process and in which portions of constant width of the chain (15) alternate with portions of degradé profile increasing or decreasing designated by numerals (16) and (17).

The chain obtained with the process according to this invention may be subjected to further operations such as beating, application of a gloss, diamond shaping operation and incisions of designs, operations which are known and which serve the purpose of increasing the aesthetic appearance. The section of the chain obtained with the process of this invention and having portions of different width or degradé may have a flat section, or an oval convex section, may be diamond shaped with several facets, may be round as shown in FIGS. 10A, 10B, 10C and 12. It should be pointed out that the invention covers all the types of chain capable of undergoing the operations of compression and beating such as eyelet, double, triple, quadruple, quintuple, foxtail and similar.

In order to make the chain, it is possible to use every type of material precious and non-precious. The rings or links may be full or empty. Further the various sections of the chain may be made with different length, different width and different inclination of the respective profile with respect to the longitudinal axis of the chain without departing from the scope of this invention.

What is claimed is:

1. A process for manufacturing an ornamental chain from a chain initially comprised of a series of individual links having the same shape, the same dimensions, and produced from the same diameter of wire, said ornamental chain having in a longitudinal direction thereof a first segment of uniform width, a second segment of uniform width greater than the width of said first segment, and a third segment interconnecting said first and second segments having a width gradually increasing linearly from the width of said first segment to the width of said second segment, said process comprising the steps of:

(a) forming the first segment of said ornamental chain by a compression action of constant value on the links of said first segment in the longitudinal direction of said chain so as to deform the profiles of said links uniformly and form said first segment with uniform width;

(b) forming the second segment of said ornamental chain by a compression action of constant value on the links of said second segment in the longitudinal direction of said chain greater than the compression action value used to form said first segment so as to deform the profiles of said links uniformly and form said second segment with uniform width greater than the width of said first segment; and (c) forming the third segment of said ornamental chain by a compression action in the longitudinal direction of said chain on discrete sections of said chain in succession with a compression action value on each discrete section being slightly greater than on the preceding discrete section and slightly less than on the succeeding discrete section so that the width of said each discrete section is intermediate the width of the two adjacent discrete sections whereby the width of said third segment gradually increases linearly from the width of said first segment to the width of said second segment of said ornamental chain.

2. The process for manufacturing an ornamental claim according to claim 1, wherein the steps of forming the first, second and third segments of said ornamental chain comprises:

(a) clamping successive discrete sections of said ornamental chain with a first clamp (6) blocking a first end of each discrete section in succession and a second clamp (7) anchored at a second end of said each successive discrete section;

(b) displacing said second clamp towards said first clamp to deform the profiles of the links of each discrete section in succession; and (c) regulating the displacement of said second clamp towards said first clamp to be a constant value during the formation of the first segment so that the width of said first segment is uniform, and to be a constant value during the formation of the second segment which is greater than the first segment constant value so that the width of said second segment is uniform and greater than the width of said first segment, and to vary during the formation of said third segment to be progressively greater on successive discrete sections of the chain between said first and second segments so that the width of said third segment increases from the width of said first segment to the width of said second segment.

3. The process for manufacturing an ornamental chain according to claim 2, wherein the extent of displacement of said second clamp (7) is regulated in a continuous manner as a function of the degree of deformation of said individual links (14).

4. The process for manufacturing an ornamental chain according to claim 2, wherein the variation of the extent of displacement of said second clamp progressively changes in a continuous manner and the variation of the micrometric value results in a plurality of interlaced links with a minimal displacement between the height of a link and an adjacent link whereby the third segment of said ornamental chain is obtained having a continuous and linear profile.

5. The process for manufacturing an ornamental chain according to claim 1, wherein the steps of forming the first, second and third segments of said ornamental chain comprises:

(a) clamping successive discrete sections of said ornamental chain with a first clamp (6) blocking a first end of each discrete section in succession and a second clamp (7) anchored at a second end of said each successive discrete section;

(b) displacing said first and second clamps towards each other to deform the profiles of the links of each discrete section in succession; and (c) regulating the displacement of said first and second clamps towards each other to be a constant value during the formation of the first segment so that the width of said first segment is uniform, and to be a constant value during the formation of the second segment which is greater than the first segment constant value so that the width of said second segment is uniform and greater than the width of said first segment, and to vary during the formation of said third segment to be progressively greater on successive discrete sections of the chain between said first and second segments so that the width of said third segment increases from the width of said first segment to the width of said second segment.

6. The process for manufacturing an ornamental chain according to claim 5, wherein the extent of displacement of said first and second clamps are regulated in a continuous manner as a function of the degree of deformation of said individual links (14).

7. The process for manufacturing an ornamental chain according to claim 5, wherein the variation of the extent of displacement of said first and second clamps progressively changes in a continuous manner and the variation of the micrometric value results in a plurality of interlaced links with a minimal displacement between the height of a link and an adjacent link whereby the third segment of said oramental chain is obtained having a continuous and linear profile.

8. The process for manufacturing an ornamental chain according to claim 1, wherein said individual links (14) are essentially ring (1') shaped having a rhomboidal shape wherein said ring has in the interior thereof a first diagonal (4) essentially perpendicular to the longitudinal direction of said chain, a second diagonal (3) essentially aligned with the longitudinal direction of said chain wherein the width of said chain depends on the dimensions of said first diagonal (4) and said links are deformed and constitute links with a new rhomboidal profile (1") wherein the dimension of said second diagonal (3) is decreased and the dimension of said first diagonal (4) is increased.

9. The process for manufacturing an ornamental chain according to claim 1, which further comprises the step of subjecting said chain to a beating operation whereby said chain passes between two beating structures, said structures having a planar base whereby said chain becomes conformed as a flat plate.

10. The process for manufacturing an ornamental chain according to claim 1, which further comprises the step of subjecting said chain to a beating operation whereby said chain passes between two beating structures, said structures having an oval shaped base whereby a lamina having an oval convex cross section is obtained.

11. The process for manufacturing an ornamental chain according to claim 1, which further comprises the step of subjecting said chain to a beating operation whereby said chain passes between two beating structures, said structures having a base shaped as a circle whereby said chain acquires a round shape.

12. The process for manufacturing an ornamental chain according to claim 1, which further comprises the step of subjecting said chain to at least one of a diamond shaping operation, a glazing operation and further incisions.

* * * * *